United States Patent [19]

Bubley et al.

[11] 4,254,708

[45] Mar. 10, 1981

[54] MECHANICAL DRIVE SCREEN PRINTING PRESS

[75] Inventors: Henry J. Bubley, Deerfield; John R. Krutsch, Glenview; Claude H. Oltra, Chicago, all of Ill.

[73] Assignee: American Screen Printing Equipment Company, Chicago, Ill.

[21] Appl. No.: 918,471

[22] Filed: Jun. 23, 1978

[51] Int. Cl.[3] ..... B41L 27/00

[52] U.S. Cl. ..... 101/123

[58] Field of Search ..... 101/123, 114–115, 101/121, 122, 116

[56] References Cited

U.S. PATENT DOCUMENTS

| | | | |
|---|---|---|---|
| 3,026,794 | 3/1962 | Nicholson | 101/123 |
| 3,477,366 | 11/1969 | Forslund | 101/123 |
| 3,955,501 | 5/1976 | Bubley | 101/123 |
| 4,058,307 | 11/1977 | Bubley | 101/123 |

*Primary Examiner*—Edgar S. Burr
*Assistant Examiner*—A. Heinz
*Attorney, Agent, or Firm*—Robert E. Wagner; Ralph R. Rath

[57] ABSTRACT

A screen printing press is provided having essentially three distinct power trains for accomplishing the infeed, printing and removal of stock from the printing bed, which power trains are completely mechanical in operation and are interconnected to operate in a timed relation with one another.

19 Claims, 13 Drawing Figures

FIG. 1
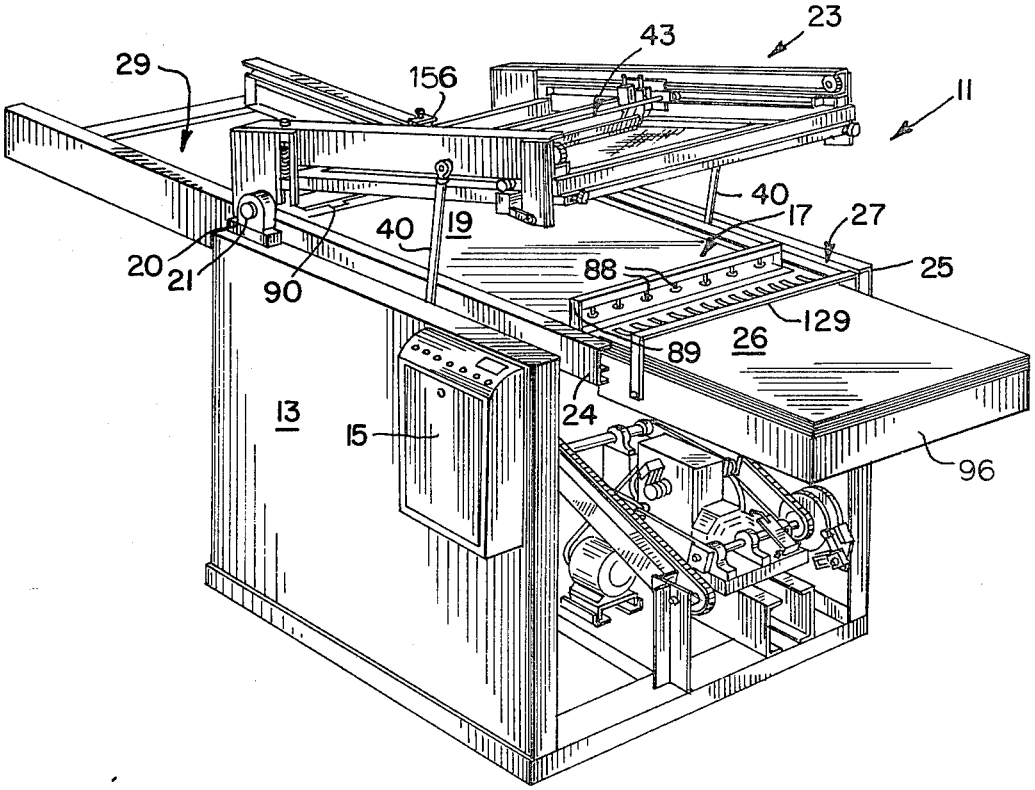
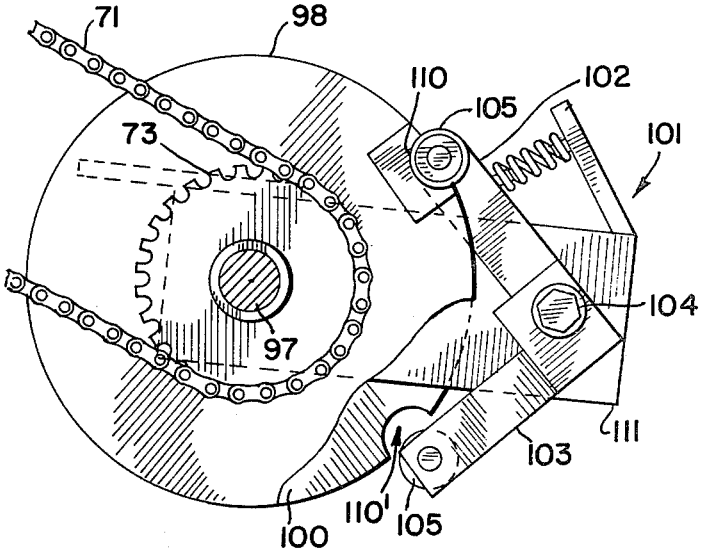
FIG. 5
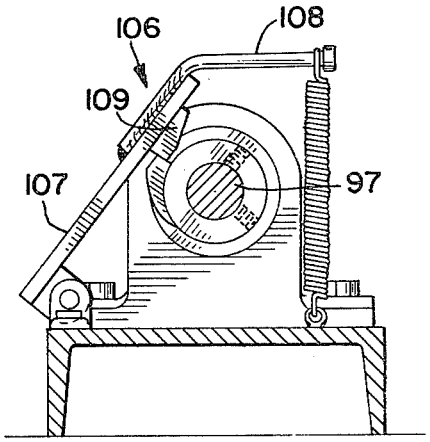
FIG. 6

FIG. 4
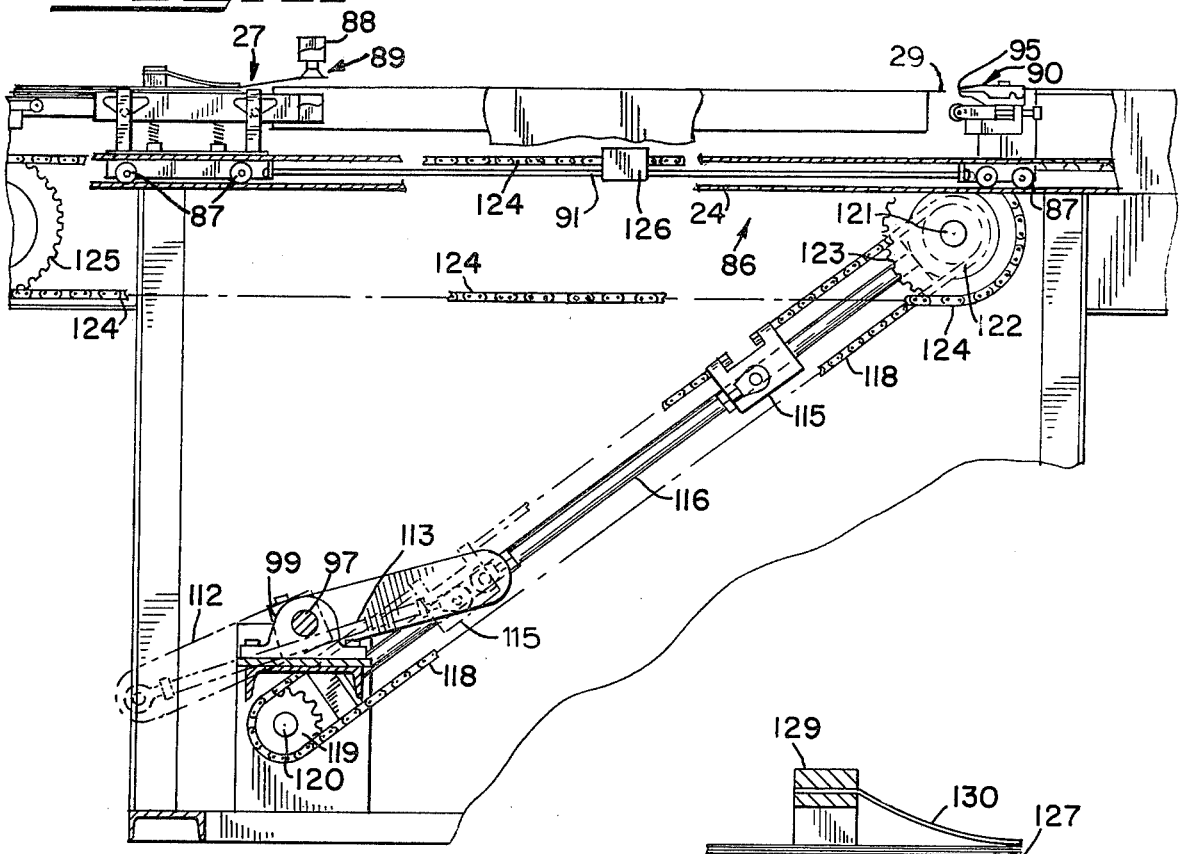
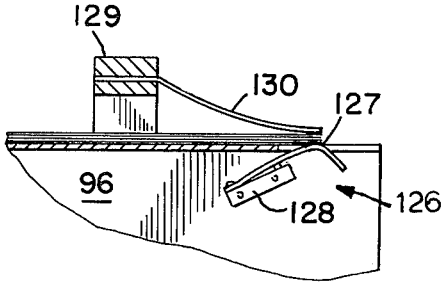
FIG. 9
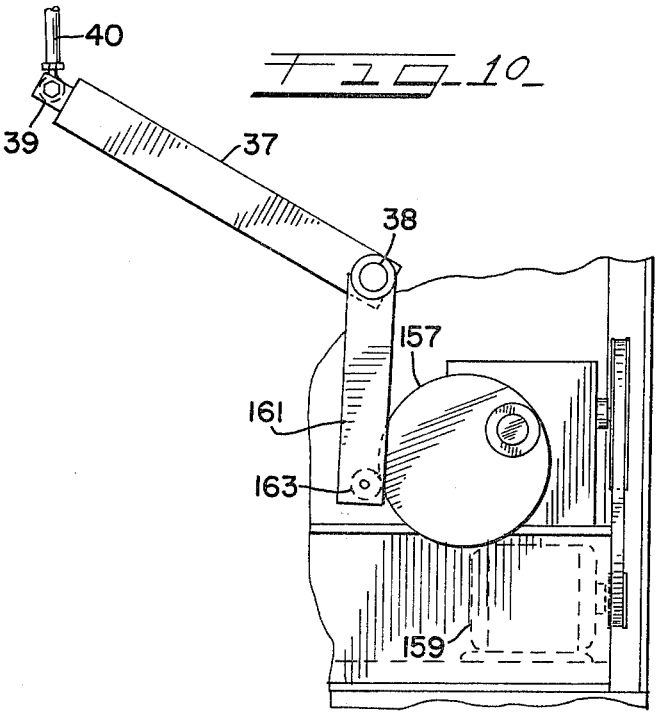
FIG. 10
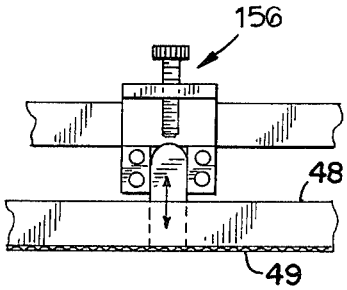
FIG. 8

MECHANICAL DRIVE SCREEN PRINTING PRESS

BACKGROUND OF THE INVENTION

This invention relates to the field of screen printing and, more particularly, to a fully automatic screen printing press operated entirely by mechanical means.

One known type of stencil screen printing device comprises a combined electro-mechanical system. Such prior art devices are sometimes referred to as flat bed printers and generally comprise a press head pivotally mounted on a fixed frame which supports a printing bed and press drive means. A printing screen is removably attached to a chase mounted beneath the press head in a position over the stock placed on the bed for printing. Mounted for reciprocal movement on the press head is a carriage assembly having a flood and squeegee bar which reciprocate across the screen during the printing cycle. Printing of stock is accomplished by lowering the carriage assembly over the stock on the printing bed, and reciprocating the squeegee across the screen to force ink therethrough to the stock.

In some of the more sophisticated versions of flat bed printers, an automatic infeed and takeoff means may be provided which acts in cooperation with the carriage assembly and press head to simultaneously place new stock on the bed for printing after removing printed stock from the bed. It is apparent that the infeed and takeoff operation and the printing cycle must act in a timed relation with one another to avoid incomplete printing of stock and possible damage to the press.

One of the more frequent problems encountered in known types of presses is the loss of synchronization between the infeed and takeoff mechanism and the press head. Normally, the infeed and takeoff operation is activated by microswitches, while the press head movement and the reciprocation of the carriage assembly are controlled by mechanical means. If an electrical failure occurred and the mechanical operation continued, the infeed apparatus could be located on the press bed as the press head makes its downward stroke, resulting in damage to the parts. To overcome this problem, redundant circuits or failsafe types of mechanisms have been proposed, but for one reason or another such systems have not proven entirely satisfactory.

SUMMARY OF THE INVENTION

Accordingly, the present invention provides an automatic press which includes an all-mechanical drive means for timing and synchronizing the infeed and takeoff operation with the printing cycle to prevent jamming or failure of the press. Some of the features of U.S. Pat. Nos. 3,859,917; 3,731,623; and 4,058,307 are utilized in the present invention and said patents are incorporated herein by reference.

The mechanical screen printing press of the present invention is divided into essentially three power trains which accomplish the three basic operations in screen printing. One power train raises and lowers the press head, a second power train reciprocates the squeegee and flood bar across the printing screen, and the third power train drives an infeed and takeoff means which removes printed stock from the bed and replaces it with new stock. As explained more fully below, the output shaft from a motor drives each of the power trains, and their operation is synchronized to accomplish the print, and infeed and takeoff cycles in a timed sequence.

In contrast to known types of screen printing presses, the power trains of the present invention are entirely mechanical in operation. As mentioned above, the infeed and takeoff operation of many existing presses is controlled by electric circuitry. One problem associated with this design is that if an electric failure occurs, the mechanically operated print cycle may continue after the infeed and takeoff means has ceased operation. In such instances, the infeed and takeoff apparatus could be located on the press bed as the press head makes its downward stroke, thus resulting in damage to the parts.

The present invention greatly reduces such problems associated with loss of synchronization by driving each of the power trains from a single drive shaft. In addition, each of the power trains is constructed of reliable mechanical parts designed for continuous operation with minimum adjustment and replacement necessary.

Therefore, it is an object of this invention to provide a screen printing press having drive means which are entirely mechanical in operation.

It is a further object of the present invention to provide a fully automated press capable of feeding, printing and removing stock using a mechanical drive train to perform these functions.

It is a still further object of this invention to provide a one-way clutch which mechanically synchronizes the infeed and takeoff means with the movement of the press head and the reciprocation of the carriage assembly.

It is another object of this invention to provide a captivated cam means adapted with a DC motor for reciprocation of the infeed and takeoff means in a timed relation with the printing function of the press.

Further objects of the invention, together with additional features contributing thereto and advantages accruing therefrom, will be apparent from the following description of one embodiment of the invention when read in conjunction with the accompanying drawings wherein:

DESCRIPTION OF THE DRAWINGS

FIG. 1 is an overall perspective view of the flat bed printing press having the mechanical drive means of the present invention;

FIG. 4 is a partial cross-sectional view in full elevation taken along the line 4—4 of FIG. 2, which shows a portion of the drive train of the infeed and takeoff cycle of the present invention;

FIG. 5 is an enlarged cross-sectional view taken along the line 5—5 of FIG. 2 which shows the one-way clutch means engaging the idler cam and also illustrating the slotted portion of the fixed cam attached to the frame of the printing press;

FIG. 6 is a cross-sectional view taken along line 6—6 of FIG. 2 which shows the safety lock mechanism of the present invention;

FIG. 8 is an enlarged front view of a tension adjustment means which is adapted with the spring biased peeling means of FIG. 7 for off-contact printing;

FIG. 9 is a side view of the elongated stock hold-down apparatus mounted transversely across the infeed portion of the press, and also a side view of the nosheet detector is provided;

FIG. 10 is a cross-sectional view in full elevation of the means for raising and lowering of the press head operating off of a second DC motor, independently of the print and infeed and takeoff cycles;

DETAILED DESCRIPTION OF THE INVENTION

Figure 2:
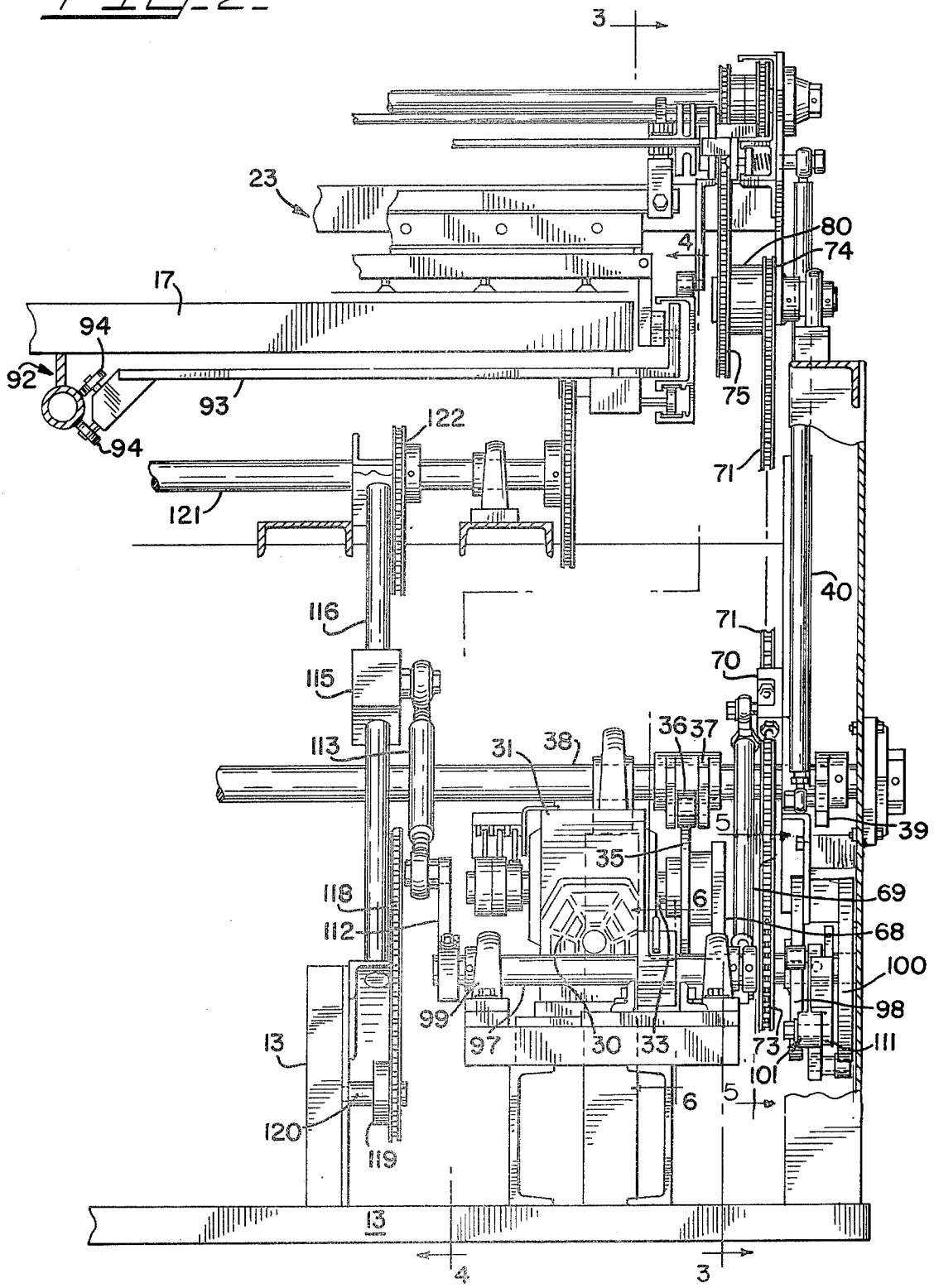
FIG. 2 is an enlarged fragmentary front view of the printing press in full elevation showing portions of the drive trains of the present invention.

Referring now to the drawings, and in particular, to FIG. 1, the screen printing press having the novel mechanical press drive means according to the present invention is indicated generally by reference numeral 11. The press 11 includes a fixed frame 13 having a control console 15 conveniently located to enable the operator to control the press 11. Mounted on the top of the frame 13 is a flat printing bed 17 (see FIG. 2), which is preferably a vacuum base of the type utilized in U.S. Pat. No. 4,058,307 to Bubley, et al. A vacuum source of negative pressure (not shown) is mounted to the frame 13 and adapted for use with the bed 17 to provide a suction to the printing surface 19 of bed 17 to hold stock 26 in a properly registered position on the bed 17 during printing. A positive pressure may be applied to the surface 19 to provide a blow back release of the stock 26 after printing, thereby facilitating removal of the stock.

Mounted on the opposite sides of the frame 13 are a pair of bearings 20 (one of which is not shown) which are connected by a fixed rod 21. A press head 23 is pivotally mounted to the fixed rod 21 for angular movement with respect to the printing bed 17 as discussed in detail hereinbelow. Also mounted near the top of frame 13 adjacent to the bed 17, are channels 24 and 25 which are adapted with the infeed and takeoff means, discussed in detail below, to take unprinted stock 26 from the infeed position 27 to the printing surface 19 for printing, and then to remove the printed stock 26 from the bed 17 to a stacking or delivery position 29.

As mentioned previously, the infeed and takeoff procedure described above was generally accomplished in prior art devices by infeed and takeoff means activated by an electrical circuit including micro-switches. A principal feature of the present invention is that the press head movement, print cycle, and infeed and takeoff operations are synchronized in a timed sequence solely by mechanical means. As discussed more fully below, the present invention reduces the possibility of jamming since a failure in the drive train will disrupt the sequential operation of the press which could discontinue the entire operation.

PRESS HEAD DRIVE TRAIN

The drive train which raises and lowers the press head 23 is shown in detail in FIG. 2. The output from a variable speed DC drive motor 30 of any known type, is fed through a belt (not shown) to a gear reducer 31 having an output shaft 33. An oblong-shaped head cam 35 (see FIG. 3) is mounted for rotation on the output shaft 33. Located rearwardly of the head cam 35, is a shaft 38 which extends across the width of the press 11 and is mounted in bearings mounted on opposite sides of the frame 13. A cam follower arm 37 is fixedly attached at one end to shaft 38 and is formed with a roller 36 at the other end which rests on head cam 35 for movement therewith.

A connecting rod 39 is attached at one end to the shaft 38 and moves angularly with the oscillation of the shaft 38. A head lifting arm 40 is disposed within the frame 13 and has its upper end attached to the press head 23 with the other end ganged to the free end of connecting rod 39. An identical connecting rod and head arm (not shown) are disposed on the opposite side of the press 11 except they are mirror images of connecting rod 39 and head arm 40. Thus, for purposes of description, reference numerals 39 and 40 will be used in connection with both pairs of connecting rods and head arms since they are dimensionally and functionally the same.

Figure 3:
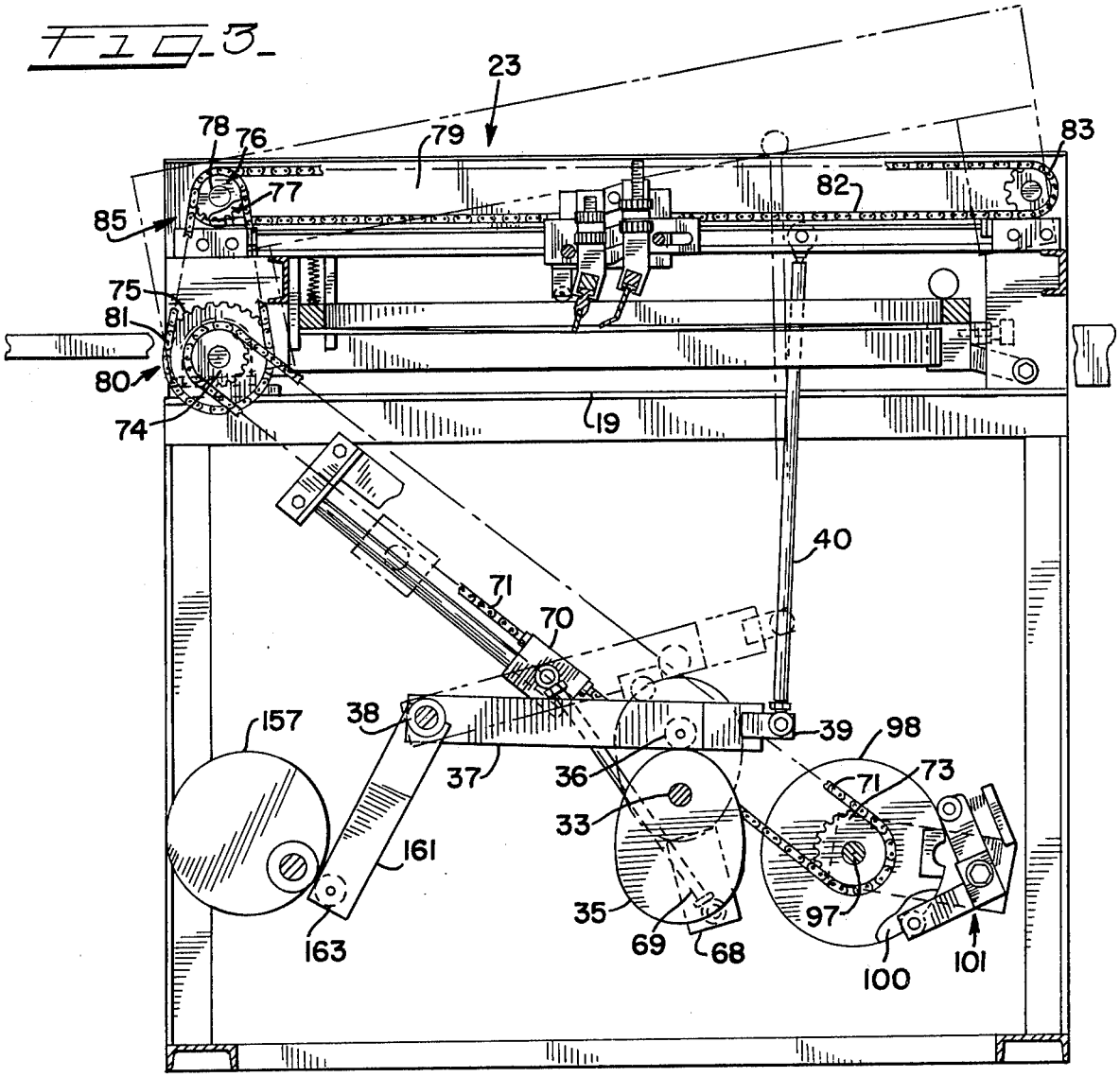
FIG. 3 is a partial cross-sectional view in full elevation taken along line 3—3 of FIG. 2 showing the drive means for raising and lowering the printing head, and a portion of the drive means for reciprocation of the carriage assembly.

With reference to FIG. 3, the press head 23 is raised and lowered as follows. The rotational output from the motor 30 rotates the head cam 35, which causes cam follower arm 37 to move up and down as it follows the oblong-shape of the head cam 35. Since the connecting rod 39 and head arms 40 are movable with shaft 38, they too are lifted and lowered in response to the rotation of head cam 35. As depicted in FIG. 3, the cam follower arm 37 is shown in solid lines in the lower position as is the head cam 35. As the head cam 35 rotates about the output shaft 33 to the position shown in dotted lines, the cam follower 37 is raised, and the connecting arms 39 and the head arms 40 raise the press head 23 to the position shown in dotted lines. When the head cam 35 returns to its original position, the press head 23 is slowly lowered over the printing bed 17 into position for the printing stroke, described below.

As shown in FIGS. 3 and 10, press head 23 may be raised and lowered independently of the print and infeed and takeoff operations, for adjustment of the press head 23 or for cleaning. A cam 157 is operatively connected to the output of a DC motor 159, which is separate from and operable independently of motor 30. A second cam follower arm 161 attaches at one end to shaft 38, and is formed with a roller 163 at the other end which rests on cam 157 and is movable therewith. As cam 157 rotates, second cam follower arm 161 causes shaft 38 to rotate and connecting rod 39 is raised and lowered in response thereto, which in turn raises and lowers press head 23 in the manner described above. Motor 159 may be stopped at any point to place press head 23 in the desired position.

Figure 11:
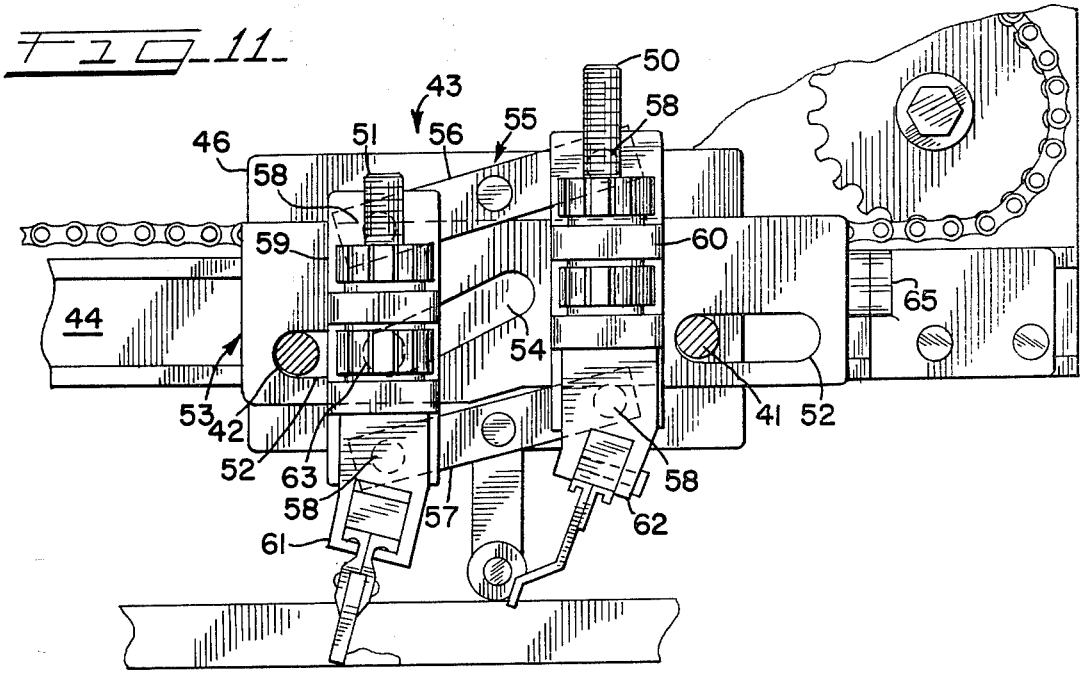
FIG. 11 is an enlarged side elevational view of the carriage assembly showing the means for pivoting the flood bar and squeegee to contact the printing screen.
Figure 12:
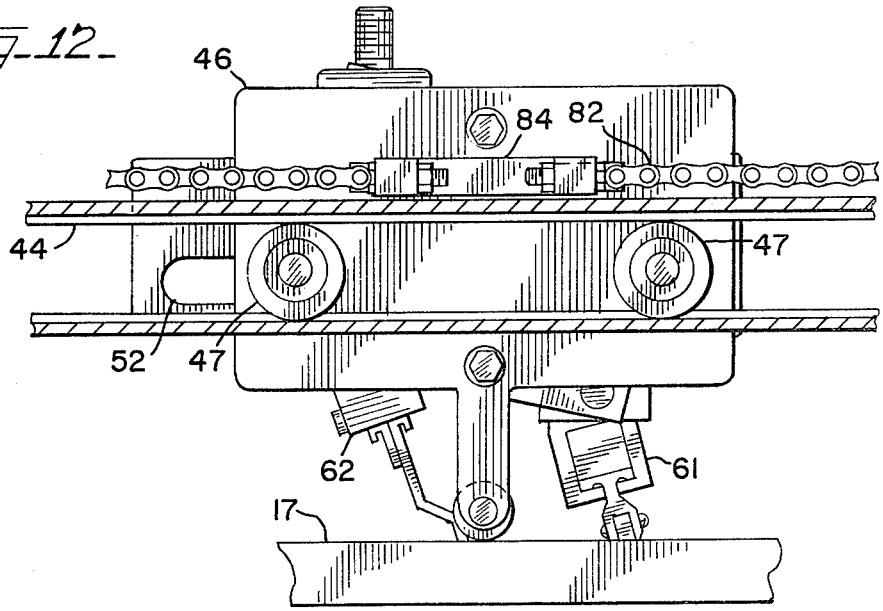
FIG. 12 is an enlarged cross sectional view of one end of the press head showing the means for mounting the carriage assembly for movement therealong; and, FIG. 13 is a cross-sectional view in full elevation showing one embodiment of the drive means for the infeed and takeoff apparatus.

Referring now to FIGS. 11 and 12, one end of a carriage assembly 43 mounted for reciprocal movement on press head 23 is shown. The other side of the carriage assembly is a mirror image of that shown in the drawings. The operation and structure of the carriage assembly 43 as viewed in FIGS. 11 and 12 is similar to that disclosed in U.S. Pat. No. 3,859,917 to Bubley et al., which may be referred to for a more complete discussion of the carriage assembly than is provided below.

The carriage assembly 43 consists of a pair of carriage housings 46, which are adapted for travel along the length of press head 23 by means of roller bearings 47 extending outwardly from carriage housings 46 and disposed for movement within carriage channels 44. The carriage housings 46 are linked to form the unitary structure of carriage assembly 43, by front and rear rods 41 and 42 extending between the channels 44 on either side of press head 23.

The remaining structure of carriage assembly 43 consists of means for pivotally mounting the flood bar 62 and squeegee 61 thereto. A shuttle 53 is provided adjacent carriage housing 46, and is supported thereagainst by front and rear rods 41 and 42 which ride in slots 52 formed in shuttle 53. Shuttle 53 is formed with a continuous Z-shaped cam track 54 which functions to shift the flood bar 62 and squeegee 61 in a generally vertical movement with respect to one another as will be discussed below. A movable parallelogram support 55 is mounted to the joining rods 50 and 51 adjacent to the shuttle 53 such that the shuttle 53 is captive between the carriage housing 46 and parallelogram support 55. The parallelogram support 55 comprises top and bottom members 56 and 57 pivotally mounted thereon through bearing bolts 58. The opposite side members 59 and 60 of the parallelogram support 55 are pivotally connected to the top and bottom sides of the parallelogram support 55 for movement in vertically opposite directions. As shown in FIGS. 11 and 12, side member 59 supports the squeegee assembly 61 and the opposite side member 60 supports the flood assembly 62.

A cam follower roller 63 is captively disposed to ride in cam track 54, and is attached through the vertical support member of the parallelogram 55 to the squeegee assembly 61. The roller 63 functions to pivot the parallelogram 55 about the bearing bolts 58 in response to linear movement of the shuttle 53 at the end of each stroke. Thus, direct movement of the squeegee assembly 61 with the roller 63 causes corresponding opposite vertical movement of the flood bar 62, providing a system in which the squeegee 61 and flood bar 62 are positively locked in constant relationship for corresponding movement.

A stop 65 is provided at each end of the press head 23 which engages with the facing end of the shuttle 53 while the carriage housing 46 and the parallelogram 55 attached thereto continues its traverse movement, thereby causing the cam follower roller 63 to be moved in the cam track 54, shifting the parallelogram 55 and lowering the squeegee assembly 61 as shown in FIG. 11. At the opposite end of the press head 23 a second stop is provided (not shown) which engages with the shuttle 53 to reverse the positions of the squeegee assembly 61 and flood assembly 62 in preparation for the flood stroke.

CARRIAGE ASSEMBLY DRIVE TRAIN

A second drive train is provided by the present invention to reciprocate the carriage assembly 43 along the carriage channels 44 to accomplish the print and flood strokes in the manner described above. Referring now to FIG. 2, the head cam 35 mounted to output shaft 33 is ganged to a first drive arm 68. A second drive arm 69 is connected at one end to the first drive arm 68 and at the other to chain block 70 to which the ends of a first drive chain 71 are attached. Rotatably mounted on a countershaft 97, disposed at the front of press 11, is an idler sprocket 73. A lower tandem sprocket 80, comprising first and second lower sprockets 74 and 75 attached together, is mounted in the lower portion of press head 23 near the rear of printing bed 17 (see FIG. 3). The first drive chain 71 is looped around the idler sprocket 73 and the first lower sprocket 74 of the lower tandem sprocket 80. The rotational movement of head cam 35 is translated into lateral movement of the first drive chain 71 and chain block 70 attached thereto, by first and second drive arms 68 and 69. Thus, lower tandem sprocket 80 and idler sprocket 73 rotate alternately in clockwise and counterclockwise directions in response to the back and forth lateral movement of first drive chain 71. (See FIG. 3).

Referring now to FIG. 3, one side of the upper portion of the drive chain which reciprocates the carriage assembly 43 is shown. The opposite side of press head 23 is virtually identical to the structure as viewed in FIG. 3 and all reference numerals used herein are applied to that side.

A channel 79 is disposed near the top of the press head 23 and extends its entire length. A shaft 78 extending the width of press head 23, is rotatably mounted within channel 79. Mounted to shaft 78 is an upper tandem sprocket 85 comprising first and second upper sprockets 76 and 77 ganged together. A third upper sprocket (not shown) corresponding to the second upper sprocket 77 of upper tandem sprocket 85, is mounted to shaft 78 on the opposite side of press head 23 for unitary movement therewith. A second drive chain 81 is looped around the upper and lower tandem sprockets 85 and 80, attaching to the first upper sprocket 76 of upper tandem sprocket 85 and the second lower sprocket 75 of lower tandem sprocket 80. A carriage drive chain 82 extends the length of press head 23 and loops around the second upper sprocket 77 and an idler sprocket 83 rotatably mounted to channel 79 at the infeed end of press head 23. The ends of carriage drive chain 82 are attached to a chain block 84 which is mounted to the carriage housing 46 of carriage assembly 43 (see FIG. 12).

Thus, a completely mechanical drive means for reciprocation of the carriage assembly 43 is provided consisting of a series of sprockets connected for synchronous motion with respect to one another by chain drives. The rotational movement of head cam 35 is translated into the back and forth lateral movement of first drive chain 71 by drive arms 68 and 69. Lower tandem sprocket 80 is driven by first drive chain 71, which in turn drives upper tandem sprocket 85. The rotational movement of upper tandem sprocket 85 is then transferred into lateral movement of carriage drive chains 82 which are looped around idler sprockets 83 and upper sprockets 77 rotatably mounted on opposite sides of press head 23. The ends of carriage drive chains 82 attach to the housing 46 of carriage assembly 43, for reciprocation back and forth along press head 23.

The raising and lowering of the press head 23 and the reciprocation of carriage assembly 43 occur in a timed relationship since both are accomplished by drive means adapted with the output shaft 33 and head cam 35. As the press head begins to raise, parallelogram 55 is rotated to place the flood bar 62 in a down position and the carriage assembly 43 travels toward the rear of the press 11 accomplishing the flood stroke. When press head 23 reaches the down position over the printing bed 17, parallelogram 55 reverses, placing the squeegee 61 in the down position, whereupon the carriage assembly 43 is advanced toward the front of press 11 for the print stroke. The cycle is then repeated.

As is well known in the art, off-contact printing is a technique wherein a printing screen is peeled away from the surface of bed 17 during the printing stroke, so that the entire screen does not rest on the stock to be printed causing smearing of the ink. A chase 48, pivotally mounted at one end to press head 23 near the front of press 11, is provided with a printing screen 49 removably mounted at the bottom of chase 48. As the squeegee 61 moves along the carriage assembly 43 during a print stroke as described above, the squeegee bar 61 forces ink through the screen 49 to the stock 26 on printing bed 17.

Figure 7:
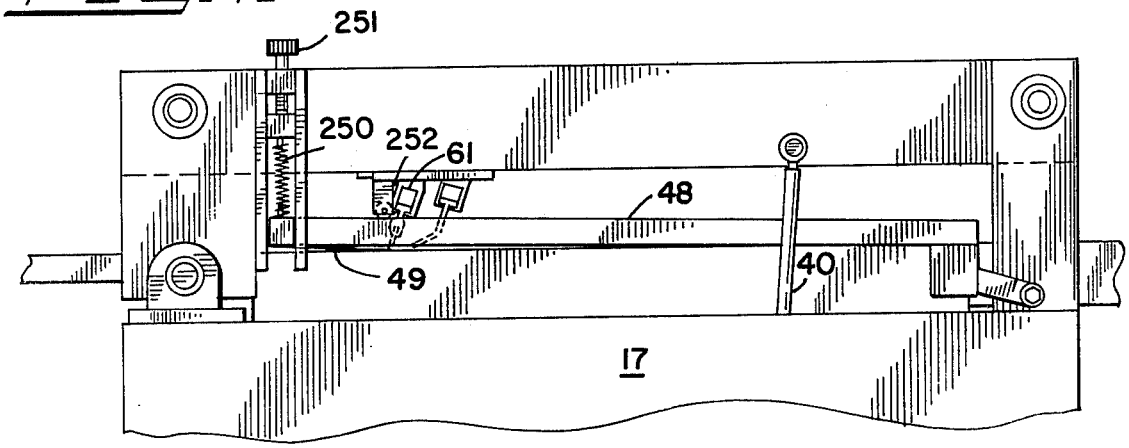
FIG. 7 is a cross-sectional view of the spring biased peeling means adapted with the printing head for off contact printing.

It is desirable to keep the ink-soaked screen 49 from contacting stock 26 to avoid smearing, except when the squeegee 61 forces the screen 49 into contact with the stock 26 during the print stroke. Accordingly, as shown in FIG. 7, the present invention provides a means to peel the screen 49 away from bed 17 so that only that part of the screen 49 directly beneath the squeegee 61 contacts stock 26. The peeling means includes a tension adjustment member 251 having a spring 250 which contacts the free end of chase 48 and constantly urges the chase 48 upwardly from the printing bed 17. As shown in FIG. 8, a chase alignment block 156 is mounted to carriage assembly 43 (see also FIG. 1), which acts as a stop to limit the vertical movement of chase 48 caused by spring 250, and also prevents the chase 48 from tilting out of alignment relative to the printing bed 17 as the chase 48 pivots upwardly. The adjustment member 251 may be adjusted to vary the tension of spring 250 to increase or decrease the upward force exerted on the chase 48.

Opposing the upward force on chase 48 are a pair of rollers 252, one of which is shown in FIG. 7, which are mounted on opposite sides of carriage assembly 43 and contact the chase 48. As the squeegee bar 61 is advanced toward the front of press head 23 during the print stroke, the screen 49 is picked up or peeled from the surface of printing bed 17 by adjustment member 251 as the chase 48 pivots upwardly. Smearing of ink on the newly printed stock 26 is thus minimized by the screen peeling means of the present invention, since the ink-soaked screen 49 is held away from printing bed 17 unless forced thereon by the squeegee bar 61 as it moves along the screen 49 during the print stroke.

As mentioned above, a principal feature of the present invention is the operation of the infeed and takeoff apparatus by mechanical means rather than using a series of micro-switches as employed by certain prior art presses. As discussed in detail below, the infeed and takeoff operation is fully synchronized with the raising and lowering of press head 23 and reciprocation of carriage assembly 43. All three drive trains are adapted with the output shaft 33 to accomplish their respective functions in a timed relationship.

The operation of the infeed and takeoff apparatus is described in the U.S. Pat. No. 4,058,307 to Bubley, et al., and reference is made thereto for a detailed discussion of the apparatus described in general terms below.

Referring now to FIGS. 1 and 4, rollers 87 are mounted to the infeed and takeoff transfer carriage 86, and are movable within channels 24 and 25 mounted on the frame 13 of the press 11 for lateral movement of the transfer carriage 86 along the length of press 11. The transfer carriage 86 includes an elongated feed gripper 89 mounted near the infeed position 27 as viewed in FIG. 1, and an elongated takeoff gripper 90 mounted near the opposite end of press 11 at the takeoff position 29. A pair of spaced parallel rods 91 connect the feed and takeoff grippers 89 and 90 for unitary movement along the length of press 11. A stabilizing track 92 (see FIG. 2) is mounted along the bottom surface of printing bed 17 in the center of press 11. A pair of bars 93 are mounted to the infeed gripper 89 beneath the printing bed 17 perpendicular to track 92. Inwardly facing rollers 94 mounted on the ends of bar 93 contact track 92, and travel therealong with the movement of transfer carriage 86. Rollers 94 provide stability for the transfer carriage 86 as it travels within channels 24 and 25 along press 11, to reduce the amount of vibration and horizontal shifting thereby assuring uniformity of registration of stock 26 on the printing bed 17.

In operation, stock 26 to be printed is stacked on a spring-biased cam operated mounting plate 96, which moves horizontally and vertically relative to the size and amount of stock 26 to be printed. The stock 26 is registered to the infeed position 27 at the outside of printing bed 17 beneath feed gripper 89, and each separate sheet is picked up from plate 96 by a series of vacuum suction cups 88 mounted on feed gripper 89. The feed gripper 89 then registers the sheets to a printing position on the printing bed 17. As the feed gripper 89 is moving toward the printing bed 17, the takeoff gripper 90, consisting of a pair of elongated parallel jaws 95 which pivot open in opposite directions, has simultaneously engaged and gripped a protruding edge of a sheet of printed stock and begun to transfer such stock to a delivery position 29. After the feeding and takeoff have been accomplished, the transfer carriage 86 is quickly returned to its initial position as the press head 23 begins its downward motion in preparation for the print stroke.

Referring to FIG. 9, a no-feed indicator labeled generally as 126, is mounted to plate 96 at the infeed position 27. No-feed indicator 126 consists of a feeder arm 127 mounted adjacent a switch 128 which is connected to the power source for drive motor 30. The feeler arm 127 contacts the bottom of the stock of stock 26 to be printed, and is pressure sensitive so that it activates switch 128 when the stock 26 is nearly gone. When the switch 128 is activated, drive motor 30 is shut down to enable an operator to place more stock 26 on plate 96 for printing. Additionally, a stock hold down means 129 is provided having extended fingers 130 to prevent the stock 26 from shifting on plate 96 during the printing operation.

INFEED AND TAKEOFF DRIVE MEANS

Figure 13:
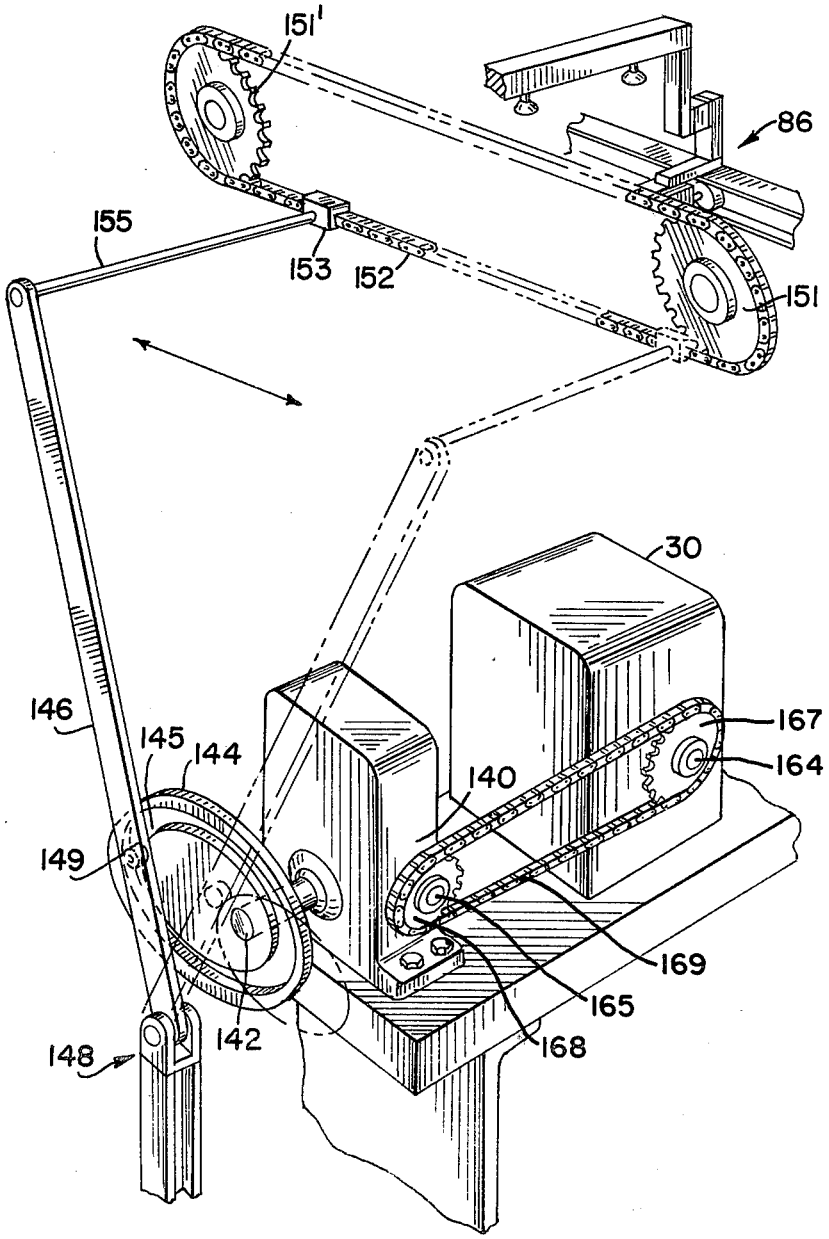

The third mechanical drive train of the present invention for the infeed and takeoff operation described above is shown in FIG. 13. DC motor 30 is provided with a drive shaft 164 connected by a bevel gear (not shown) to output shaft 33 for rotation therewith. A second gear reducer 140 is mounted opposite motor 30 and has a shaft 165 in alignment with drive shaft 164 of motor 30. A bevel gear in gear reducer 140 connects shaft 165 to an output shaft 142 for unitary movement therewith. Mounted on shafts 164 and 165 are sprockets 167 and 168, which are connected together by a link chain 169. Thus, the output from motor 30 is translated from output shaft 33 through the cooperating sprockets 167 and 168, to the drive shaft 142 of gear reducer 140.

The drive shaft 142 from gear reducer 140 is connected at its free end to a drive cam 144 which is formed with a track 145. A drive arm 146 is pivotally mounted to a support member 148 positioned near the front of the frame 13 of press 11. A roller 149 attached to drive arm 146 is captively disposed within the track 145 of drive cam 144 for movement therealong. As the cam 144 is rotated, the roller 149 travels along the track 145 causing the drive arm 146 to reciprocate from the back of printing bed 17 to the front.

A pair of idler sprockets 151 and 151' are mounted to opposite ends of printing bed 17, and are connected by a chain 152 looped around them for synchronous movement. The transfer carriage 86 of the infeed and takeoff means is connected to the free ends of chain 152 for movement therewith. A chain block 153 is disposed along chain 152 between idler sprockets 151 and 151', and communicates with drive arm 146 through a connecting rod 155 attached therebetween.

The transfer carriage 86 is thus reciprocated along the press 11 by movement of drive arm 146. As cam 144 is rotated by shaft 142, the drive arm 146 is moved back and forth in response to the travel of roller 149 along track 145 within cam 144. The chain 152 and transfer carriage 86 connected thereto, are reciprocated by the connecting rod 155 which is attached at one end to the drive arm 146 and at the other to chain block 153. The reciprocation of drive arm 146 is timed to correspond to the raising and lowering of press head 23 and to the printing cycle. The cam 144 is formed to provide a period of dwell where the drive arm 146 remains stationary, during which the press head 23 is in a lowered position on the printing bed 17 for the print stroke. As the press head 23 is raised from the printing bed 17, the roller 149 reaches a point along the track 145 is cam 144 at which the back and forth movement of drive arm 146 is resumed. In response to the reciprocation of drive arm 146, the transfer carriage 86 simultaneously removes the newly printed stock 26 from the bed 17 and registers a new piece of stock 26 to the bed 17 for printing, and is then reciprocated back to its original position as the press head 23 is lowered to repeat the print stroke.

INFEED AND TAKEOFF DRIVE MEANS ALTERNATIVE EMBODIMENT

An alternative embodiment of the mechanical drive train for the infeed and takeoff operation is adapted with the head cam 35 as discussed in detail below. Referring now to FIG. 2, the idler sprocket 73 adapted with head cam 35 as discussed above in connection with the carriage assembly reciprocation drive means, is fixedly attached to a slotted idler cam 98. Both idler sprocket 73 and idler cam 98 are pivotally mounted to a countershaft 97 which is rotatably mounted to the frame 13 at one end and to a bearing 99 at the other end. A slotted fixed cam 100 is mounted to the frame 13 adjacent idler cam 98 and concentric to countershaft 97.

As is shown in FIG. 5, a unique one-way clutch labeled generally as 101, is provided by the present invention which allows the countershaft 97 to rotate in the counterclockwise direction only, for purposes to become apparent below. Clutch 101 includes a spring-biased arm 102 and a second arm 103 ganged together to form a right angle by pin 104. Pin 104 is mounted at its free end to a mounting arm 111, which is fixed to countershaft 97 for unitary movement of the clutch 101 therewith. A roller bar 105 is mounted on the free ends of arms 102 and 103, which is adapted to fit into slots 110 and 110' formed in the idler cam 98 and fixed cam 100, respectively, as discussed below.

The operation of the clutch 101 is shown in FIGS. 3 and 5. As the idler sprocket 73 beings to rotate in a counterclockwise direction, in response to first drive chain 71 as discussed above, the idler cam 98 rotates therewith. The roller bar 105 of the spring-biased arm 102 is constantly urged against the outer edge of idler cam 98 and rides thereon until it reaches slot 110 formed in idler cam 98. The roller bar 105 of the spring-biased arm 102 is then forced into slot 110 of the idler cam 98, which disengages the roller bar 105 of second arm 103 from the slot 110' formed in fixed cam 100. When the spring-biased arm 102 is engaged with idler cam 98, the clutch 101 and countershaft 97 rotate with idler cam 98. Spring-biased arm 102 remains in engagement with idler cam 98 for slightly more than one revolution in the counterclockwise direction, allowing the spring-biased arm to disengage as the idler cam 98 reverses its direction of rotation. As the spring-biased arm 102 disengages, the second arm 102 pivots and contacts the outer edge of fixed cam 100. As the idler cam 98 continues its clockwise rotation, the roller bar 105 of second arm 103 engages with the slot 110' in fixed cam 100 which holds the clutch 101 and countershaft 97 in a fixed position during the clockwise rotation of idler cam 98.

Referring now to FIG. 6, a lock mechanism 106 is provided as a safety measure to assure rotation of the countershaft 97 in the counterclockwise direction only. The safety lock mechanism is comprised of a lock arm 107 biased toward the countershaft 97 by a spring-biased arm 108. A stop 109 is provided on the underside of the lock arm 107 which engages with countershaft 97 should it begin to move in a clockwise direction.

Referring now to FIGS. 2 and 4, countershaft 97 attaches at its free end to a main feed and takeoff drive arm 112. A second drive arm 113 is attached at one end to main drive arm 112, and at the other end to a chain block 115 movable along a guide arm 116 attached to the frame 13. The second drive arm 113 converts the rotational movement of main drive arm 112, to the lateral back and forth movement of chain block 115 along guide arm 116. An idler sprocket 119 is provided which is rotatably mounted to a cantilever shaft 120 disposed forwardly and at the base of frame 13. A first drive sprocket 122 is mounted at one end of a shaft 121 which is disposed beneath the transfer carriage 86 rearwardly of printing bed 17, the shaft 121 being rotatably mounted to the frame 13 at one end and to a bearing at the other end.

A first drive chain 118 is looped around idler sprocket 119 and first drive sprocket 122. The ends of first drive chain 118 are attached to chain block 115 such that lateral movement of the second drive arm 113 and the chain block 115 along guide arm 116 causes first drive chain 118 to move therewith. Thus, the back and forth lateral movement of first drive chain 118 is converted to a clockwise and counterclockwise rotational movement by first drive sprocket 122 attached thereto.

A second drive sprocket 123 is mounted opposite first drive sprocket 122 on shaft 121 and is movable therewith. An idler sprocket 125 is rotatably mounted to frame 13 at the other end of press 11 near the infeed position 27. A transfer chain 124 is looped around idler sprocket 125 and second drive sprocket 123, the ends of transfer chain 124 being attached to chain block 126 which is mounted on the transfer carriage 86. Although the structure described above refers to the side of the infeed and takeoff transfer carriage 86 as viewed in FIG. 4, the reference numerals are applied to the opposite side of the transfer carriage as well which is the mirror image of that in FIG. 4.

The entire feed and takeoff cycle is thus accomplished in slightly more than a single counterclockwise revolution of idler cam 73, in a timed relation with the raising and lowering of the press head 23 and reciprocation of carriage assembly 43. During the rotation of idler cam 98 in the opposite or clockwise direction, the transfer carriage 86 is at rest and thus the operation of the infeed and takeoff drive means is intermittent in nature as opposed to the continuous operation of the drive means for the print cycle discussed above. As the clutch 101 allows the countershaft 97 to rotate, the rotational movement is converted by the drive arms 112 and 113 to a back and forth lateral movement of chain block 115 along guide arm 116. A complete back and forth motion of chain block 115 along guide arm 116 is accomplished in one revolution of idler cam 73. The lateral motion of chain block 115 is transferred by first drive chain 118 to first drive sprocket 122 such that first drive sprocket 122 rotates in one direction, and then reverses its rotation as the chain block 115 is pulled back along guide arm 116 in the opposite direction. This alternating clockwise and counterclockwise rotation is transmitted to shaft 121 and then to the second drive sprocket 123 mounted thereto. The transfer carriage 86 is reciprocated along channels 24 and 25 by transfer chains 124 which are looped around the second drive sprockets 123 and idler sprockets 125, and attached to transfer carriage 86 by means of chain blocks 126.

A screen printing press is thus provided in which raising and lowering of the press head, reciprocation of the carriage assembly, and infeed and takeoff of stock are all accomplished by mechanical drive means acting in timed synchronization from the output of a single power source. The press does not depend on electric circuitry to drive a portion of the press operation, as was the case in certain prior art devices, and thus avoids problems such as jamming caused by failure of one of the drive trains, which could severly damage a press. It will be understood from an examination of the foregoing that the press of the present invention may be fabricated without an infeed and takeoff means, using the identical drive means for raising and lowering the press head and reciprocating the carriage assembly, which would provide for manual stacking of the printed stock. The mechanical operation of the present invention is durable and reliable, and also significantly reduces the costs of fabrication, maintenance and adjustment of the press.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A flat-bed printing press having a frame, the improvement comprising a power source, an output shaft driven by said power source, a pivotally mounted press head, first mechanical means communicating with said output shaft to raise and lower said press head, a carriage assembly reciprocally movable as said press head raises and lowers, second mechanical drive means communicating with said output shaft to reciprocate said carriage assembly along said press head in a timed relationship to the raising and lowering of said press head, a transfer carriage having a stock infeed and takeoff means for transferring stock, a third mechanical drive means communicating with said output shaft to drive said transfer carriage for operating said stock infeed and takeoff means in a timed cycle with said press head drive means and said carriage assembly drive means, whereby stock to be printed is placed on said printing bed, printed, and then transferred from said bed in a mechanically synchronized operation wherein said second mechanical drive means for reciprocation of said carriage assembly comprises:

a first tandem sprocket rotatably mounted to said press head;

a lower sprocket rotatably mounted to a countershaft;

a first chain looped around said first tandem sprocket and said lower sprocket, the ends of said first chain attaching to a chain block;

drive arm means movable with said output shaft, and connecting at one end to said chain block for reciprocating said first chain in an essentially linear path between said lower sprocket and said first tandem sprocket in response to the rotation of said output shaft;

a second tandem sprocket movable with a head shaft rotatably mounted to said press head;

a second chain looped around said first tandem sprocket and said second tandem sprocket, said second chain movable in an essentially linear path between said first and second tandem sprockets in response to the rotation of said first tandem sprocket;

idler sprocket means rotatably mounted to said press head opposite said second tandem sprocket; and, idler chains looped around said idler sprocket means and said second tandem sprocket, the ends of said idler chains connecting to a chain block attached to said carriage assembly whereby rotation of said second tandem sprocket reciprocates said idler chains and said carriage assembly movable therewith along said press head.

2. The printing press of claim 1 wherein said first mechanical drive means for raising and lowering said press head comprises:

a head cam mounted to said output shaft for rotation therewith;

a shaft rotatably mounted adjacent said head cam;

a cam follower arm attached to said shaft at one end and contacting said head cam for movement therewith, said cam follower arm moving upwardly and downwardly in response to the rotation of said head cam; and, a pair of head lifting arms mounted on opposite sides of said press head at one end and movable with said cam follower arm, whereby as said head cam rotates with said output shaft said cam follower arm moves upwardly and downwardly in response thereto, thereby raising and lowering said head lifting arms to move said press head attached thereto toward and away from said printing bed for printing of said stock.

3. The printing press of claim 1 wherein said third mechanical drive means for driving said infeed and takeoff means comprises:

a gear reducer driven by said output shaft, said gear reducer having a drive shaft;

a drive cam attaching to said drive shaft of said gear reducer for rotational movement therewith, said drive cam being formed with a track;

a drive arm pivotally mounted at one end to said frame and extending upwardly beneath said printing bed, said drive arm having a roller engageable with said track of said drive cam for movement therealong, said drive arm reciprocating essentially laterally back and forth beneath said printing bed in response to the rotation of said drive cam as said roller follows said track formed therein;

idler sprockets rotatably mounted to said frame at opposite ends of said press;

a link chain looped around said idler sprockets and attaching to said transfer carriage at a point therealong; and, means connecting said drive arm to said link chain whereby said transfer carriage reciprocates back and forth along said printing bed with said drive arm, said infeed and takeoff means of said transfer carriage simultaneously transferring printed stock from said printing bed and unprinted stock thereto for printing.

4. In a printing press including a support frame, a printing bed supporting on said frame and having an upwardly facing surface to receive stock to be printed, a press head pivotally mounted to said support frame for angular movement relative to said printing bed and said support frame, a chase pivotally mounted beneath said press head and being positioned over said stock on said printing bed, a screen removably mounted on said chase, a carriage assembly mounted to said press head for movement therealong relative to said screen and said chase, said carriage assembly having a squeegee bar and flood bar mounted thereon for movement relative to one another, a pair of head arms mounted on opposite sides of said press head for movement therewith toward and away from said printing bed, a transfer carriage adapted with carriage channels mounted to said frame beneath said printing bed for movement therealong relative to said frame, said transfer carriage having an infeed and delivery means attached thereto for simultaneous transfer of stock to and from said printing bed; the improvement comprising:

a power source;

an output shaft driven by said power source;

a first mechanical drive means operatively communicating with said output shaft for raising and lowering said press head relative to said printing bed;

a second mechanical drive means operatively communicating with said output shaft for reciprocating said carriage assembly along said press head to accomplish the print cycle in a timed relation with the raising and lowering of said press head by said press head drive means;

a third mechanical drive means including a cam means in communication with said output shaft for operation of said infeed and takeoff means in a timed cycle with the raising and lowering of said press head and reciprocation of said carriage assembly wherein said second mechanical drive means for reciprocation of said carriage assembly comprises:

a first tandem sprocket rotatably mounted to said press head;

a lower sprocket rotatably mounted to a countershaft;

a first chain looped around said first tandem sprocket and said lower sprocket, the ends of said first chain attaching to a chain block;

drive arm means movable with said output shaft, and connecting at one end to said chain block for reciprocating said first chain in an essentially linear path between said lower sprocket and said first tandem sprocket in response to the rotation of said output shaft;

a second tandem sprocket movable with a hand shaft rotatably mounted to said press head;

a second chain looped around said first tandem sprocket and said second tandem sprocket, said second chain movable in an essentially linear path between said first and second tandem sprockets in response to the rotation of said first tandem sprocket;

idler sprocket means rotatably mounted to said press head opposite said second tandem sprocket; and, idler chains looped around said idler sprocket means and said second tandem sprocket, the ends of said idler chains connecting to a chain block attached to said carriage assembly whereby rotation of said second tandem sprocket reciprocates said idler chains and said carriage assembly movable therewith along said press head.

5. The printing press of claim 4 further including indicator means for automatically stopping the press operation when a stack of unprinted stock at said infeed end of said press reaches a predetermined level, said indicator means including a switch in electrical contact with said power source, and a pressure sensitive arm connected to said switch at one end, the other end of said arm extending beneath said stack of unprinted stock for sensing the level thereof, whereby as said stack of unprinted stock reaches a predetermined level said arm activates said switch to stop said power source permitting additional unprinted stock to be placed on said stack.

6. The printing press of claim 4 wherein said squeegee bar is moveable along said screen to force ink therethrough to said stock on said printing bed, said printing press further including the combination of screen peeling means and roller means cooperating to reduce smearing of ink on said stock, said screen peeling means including a spring-biased tension member mounted to said press and attaching to one end of said chase, said tension member constantly urging said chase and screen upwardly away from said printing bed, said roller means being mounted to said carriage assembly and moveable therewith, said roller means contacting said chase and urging said chase downwardly toward said printing bed in opposition to said tension member, whereby as said squeegee bar moves along said screen forcing said screen into contact with said stock on said printing bed, said tension member urges said screen away from said printing bed thereby permitting only the portion of said screen beneath said squeegee bar to contact said stock, said roller means simultaneously opposing said tension member thereby enabling said chase and screen to move upwardly at a controlled rate, said tension member and said roller means cooperating to reduce smearing of ink on said stock.

7. In a printing press including a support frame, a printing bed supported on said frame and having an upwardly facing surface to receive stock to be printed, a press head pivotally mounted to said support frame for angular movement relative to said printing bed and said support frame, a chase pivotally mounted beneath said press head and being positioned over said stock on said printing bed, a screen removably mounted on said chase, a carriage assembly mounted to said press head for movement therealong relative to said screen and said chase, said carriage assembly having a squeegee bar and flood bar mounted thereon for movement relative to one another, a pair of head arms mounted on opposite sides of said press head for movement therewith toward and away from said printing bed, a transfer carriage adapted with carriage channels mounted to said frame beneath said printing bed for movement therealong relative to said frame, said transfer carriage having an infeed and delivery means attached thereto for simultaneous transfer of stock to and from said printing bed; the improvement comprising:

a power source, said power source driving an output shaft;

a first mechanical drive means operatively communicating with said output shaft for raising and lowering said press head relative to said printing bed;

a second mechanical drive means operatively communicating with said output shaft for reciprocating said carriage assembly along said press head to accomplish the print cycle in a timed relation with the raising and lowering of said press head by said press head drive means;

an intermittent mechanical drive means for operation of said infeed and delivery means synchronously with the raising and lowering of said press head and reciprocation of said carriage assembly wherein said intermittent drive means comprises:

a first tandem sprocket rotatably mounted to a countershaft for movement therewith;

an idler sprocket rotatably mounted to a countershaft for movement therewith;

a first chain looped around said first tandem sprocket and said idler sprocket, the ends of said chain attaching to a chain block;

first drive arm means movable with said output shaft, and connecting at one end to said chain block for reciprocating said first chain between said first tandem sprocket and said idler sprocket in response to the rotation of said output shaft, said idler sprocket rotating alternately in one direction and then in the opposite direction with the reciprocation of said first chain;

an idler cam attached to said idler sprocket on said countershaft and movable therewith;

a fixed cam attached to said press frame adjacent said idler cam and concentric to said countershaft;

a one-way clutch means fixed to said countershaft and alternately engageable with said idler cam and said fixed cam, said clutch means and countershaft rotating in one direction as said clutch engages said idler cam, said clutch means engaging said fixed cam as said idler cam rotates in said opposite direction thereby being prevented from rotating in said opposite direction;

a drive shaft rotatably mounted to said frame at one end of said press;

a first upper sprocket mounted at one end of said drive shaft for movement therewith;

a lower sprocket rotatably mounted to said frame in alignment with said first upper drive sprocket;

a second chain looped around said first upper drive sprocket and said lower drive sprocket for movement therewith;

second drive arm means movable with said countershaft, and connecting at one end to said second chain for reciprocating said second chain in an essentially linear path between said first upper drive sprocket and said lower drive sprocket in response to the rotation of said countershaft;

a second upper sprocket fixed to said drive shaft opposite said first upper sprocket;

a third upper sprocket rotatably mounted to said frame opposite said second upper sprocket;

a third chain looped around said second upper sprocket and said third upper sprocket, the ends of said chain attaching to said transfer carriage, a third chain reciprocating in an essentially linear path between said second and third upper sprockets whereby said transfer carriage attached thereto reciprocates back and forth along said carriage channels for transfer of stock to said printing bed for printing and simultaneous removal of printed stock from said bed in a timed relationship with the raising and lowering of said press head and reciprocation of said carriage assembly.

8. The printing press of claim 7 wherein said second mechanical drive means for reciprocation of said carriage assembly comprises:

a first tandem sprocket rotatably mounted to said press head;

a lower sprocket rotatably mounted to a countershaft;

a first chain looped around said first tandem sprocket and said lower sprocket, the ends of said first chain attaching to a chain block;

drive arm means movable with said output shaft, and connecting at one end to said chain block for reciprocating said first chain in an essentially linear path between said lower sprocket and said first tandem sprocket in response to the rotation of said output shaft;

a second tandem sprocket movable with a head shaft rotatably mounted to said press head;

a second chain looped around said first tandem sprocket and said second tandem sprocket, said second chain movable in an essentially linear path between said first and second tandem sprockets in response to the rotation of said first tandem sprocket;

idler sprocket means rotatably mounted to said press head opposite said second tandem sprocket; and, idler chains looped around said idler sprocket means and said second tandem sprocket, the ends of said idler chains connecting to a chain block attached to said carriage assembly whereby rotation of said second tandem sprocket reciprocates said idler chains and said carriage assembly movable therewith along said press head.

9. The printing press of claim 7 wherein said one-way clutch means comprises first and second clutch arms each formed with an engaging means at one end and attached together at the other end in a generally perpendicular relationship, said idler cam and said fixed cam being formed with slots, said engaging means of said first arm being engageable with the slot in said idler cam, said engaging means of said second arm being engageable with the slot in said fixed cam, said first arm being biased toward said idler cam whereby as said idler cam rotates in one direction said first arm engages with the slot therein causing said clutch and said countershaft attached thereto to rotate therewith, and as said idler cam rotates in the opposite direction in response to said first chain, said second arm engages with the slot in said fixed cam simultaneously disengaging said first arm from said idler cam, said fixed cam preventing rotation of said clutch and said countershaft in the opposite direction and thus permitting intermittent rotation of said countershaft in one direction only.

10. In a printing press including a support frame, a printing bed supported on said frame having an upwardly facing surface to receive stock to be printed and adapted to have a transfer carriage associated therewith with an infeed and take-off apparatus at opposite ends of said surface for supplying and removing stock, a press head pivotally mounted at one end on said frame above said bed for movement between raised and lowered positions, said head including a pair of members extending along opposite sides of said printing bed and having inwardly directed elongated channels, a carriage assembly having opposed lateral edges with bearing means extending from said lateral edges and received in respective channels for reciprocable motion along said channels, said carriage assembly having a squeegee assembly and a flood assembly mounted thereon for movement relative to one another, and mechanical drive means for pivoting said head and reciprocating said carriage assembly, said mechanical drive means including a pair of rods respectively pivoted on intermediate portions of said members and extending downwardly on opposite sides of said printing bed, a shaft rotatably supported on said frame and having a pair of head arms rotatable therewith with said head arms having free ends pivotally interconnected with the respective rods, a power source having an output shaft with a head cam on said output shaft and a cam follower secured to said rotatable shaft and engaging said cam so that said press head is pivoted between raised and lowered positions in response rotation of said cam, a drive arm secured to said output shaft and having a free end rotatable therewith, a drive sprocket rotatably supported on said press head adjacent the pivotal mounting of said head and operatively connected to said free end of said drive arm to alternately rotate said drive sprocket in opposite directions in response to each revolution of said output shaft, and means between said drive sprocket and said carriage assembly for reciprocating said carriage assembly along said channels in timed relation to the raising and lowering of said press head.

11. A printing press as defined in claim 10, in which said operative connection between said drive arm and said drive sprocket includes an elongated chain entrained over said sprocket at one end an idler sprocket at the opposite end with a link between said drive arm and said elongated chain for reciprocating said chain in an essentially linear path in response to rotation of said output shaft.

12. A printing press as defined in claim 11, in which said means between said drive sprocket and carriage assembly includes idler sprocket means rotatably mounted on opposite ends of said press head with idler chains entrained over said idler sprocket means and attached to said carriage assembly and a drive chain between one of said idler sprocket means and said drive sprocket.

13. A printing press as defined in claim 10, further including a further pair of inwardly directed channels on opposite sides of said surface with a transfer carriage having roller means at opposite ends received into said further pair of channels for supporting and guiding said transfer carriage, and means between said output shaft and said transfer carriage for reciprocating said roller means along said further pair of channels to reciprocate said transfer carriage.

14. A printing press as defined in claim 13, in which said means between said output shaft and transfer carriage includes a transfer cam rotated by said output shaft and a drive arm pivoted at one end on said frame with a cam follower on said drive arm engaging said transfer cam, idler sprockets rotatably mounted on said frame at opposite ends of said press with a chain entrained over said idler sprockets and connected to said transfer carriage and an opposite end of said drive arm to reciprocate said transfer carriage in response to rotation of said transfer cam.

15. A printing press as defined in claim 13, in which said means between said output shaft and said transfer carriage includes idler sprockets rotatably mounted on said frame at opposite ends of said press with an idler chain entrained over said idler sprockets and connected to said transfer carriage, a drive chain supported on said frame operable to reciprocate said idler chain and transfer carriage and means between said drive chain and said output shaft for intermittently reciprocating said drive chain in response to rotation of said output shaft.

16. In a printing press including a support frame, a printing bed supported on said frame and having an upwardly facing surface to receive stock to be printed, a press head pivotally mounted to said support frame for angular movement relative to said printing bed and said support frame and having a pair of head arms mounted on opposite sides of said surface for movement therewith between raised and lowered positions, a chase pivotally mounted beneath said press head and being positioned over said stock on said printing bed, a screen removably mounted on said chase, a carriage assembly mounted to said press head for movement therealong relative to said screen and said chase, said carriage assembly having a squeegee bar and flood bar mounted thereon for movement relative to one another, a transfer carriage adapted with carriage channels mounted to said frame beneath said printing bed for movement therealong relative to said frame, said transfer carriage having an infeed and delivery means attached thereto for simultaneous transfer of stock to and from said printing bed; the improvement comprising: a power source, said power source driving an output shaft; and mechanical drive means connected to said output shaft for reciprocating said carriage assembly along said press head to accomplish the print cycle in a timed relation with the raising and lowering of said press head; said mechanical drive means including an endless drive chain entrained over first and second sprockets respectively supported on said frame and said press head, means between said output shaft and said drive chain for imparting essentially linear reciprocating motion to said drive chain in response to rotaton of said output shaft to alternately rotate said second sprocket on said press head in opposite directions in response to each revolution of rotation of said output shaft, and means on said press head between said carriage assembly and said second sprocket for reciprocating said carriage assembly in response to rotation of said second sprocket.

17. A printing press as defined in claim 16, further including a transfer drive chain supported on said frame and operatively connected to said transfer carriage and drive means between said first sprocket and said transfer drive chain including a one-way clutch for intermittently linearly reciprocating said transfer chain in response to rotation of said first sprocket in one direction to reciprocate said transfer carriage on said frame.

18. A printing press as defined in claim 16, further including a transfer cam rotated on said frame and driven by said output shaft, a transfer arm having one end pivoted on said frame and a cam follower spaced from said one end so that rotation of said transfer cam will reciprocate the opposite end of said transfer arm essentially linearly, and connection means between the opposite end of said transfer arm and said transfer carriage to reciprocate said transfer carriage on said frame.

19. A printing press as defined in claim 16, further including a head cam rotated on said frame by said output shaft, a driven shaft rotatably supported on said frame and having a cam follower engaging said head cam to impart rotary oscillatory motion to said driven shaft and connection means between said driven shaft and said head arms for raising and lowering said press head in response to oscillation of said driven shaft.

* * * * *